US010399241B2

(12) United States Patent
Runstrom

(10) Patent No.: US 10,399,241 B2
(45) Date of Patent: Sep. 3, 2019

(54) CORNER-ROUNDING COMPRESSION CUTTER FOR ROOFING MATERIAL

(71) Applicant: Jerry L. Runstrom, Kingsley, MI (US)

(72) Inventor: Jerry L. Runstrom, Kingsley, MI (US)

( * ) Notice: Subject to any disclaimer, the term of this patent is extended or adjusted under 35 U.S.C. 154(b) by 0 days.

(21) Appl. No.: 15/704,080

(22) Filed: Sep. 14, 2017

(65) Prior Publication Data

US 2018/0229388 A1 Aug. 16, 2018

Related U.S. Application Data

(60) Provisional application No. 62/458,642, filed on Feb. 14, 2017.

(51) Int. Cl.
*B26D 3/10* (2006.01)
*B26B 17/00* (2006.01)
*E04D 15/04* (2006.01)

(52) U.S. Cl.
CPC ..... *B26D 3/10* (2013.01); *E04D 15/04* (2013.01); *B26B 17/006* (2013.01)

(58) Field of Classification Search
CPC ..... B26D 3/10; E04D 15/04; B26B 17/006
USPC ..... 30/178, 179, 186, 187, 188, 189, 190, 30/191–193
See application file for complete search history.

(56) References Cited

U.S. PATENT DOCUMENTS 1,098,696 A * 6/1914 Thom ..... B26F 1/36 144/146
1,146,610 A * 7/1915 Altman ..... B26B 25/00 30/178
2,254,738 A * 9/1941 Gamache ..... B26B 17/00 30/175
2,493,513 A * 1/1950 Wagner ..... B26F 1/12 30/178
2,582,736 A * 1/1952 Altieri ..... B26B 17/00 30/178
2,612,686 A * 10/1952 Wagner ..... B26F 1/12 30/178
3,659,343 A * 5/1972 Straus ..... A61B 17/0467 30/124
3,807,930 A * 4/1974 Steidel ..... B29C 57/00 425/392

(Continued)

OTHER PUBLICATIONS

Oregon Lamination Premium; 3mm Radius Corner Rounder Punch Cutter—Heavy Duty Clipper approx 1/8-inch; Amazon.com product listing; Apr. 1, 2011; 7 pages; www.amazon.com (https://www.amazon.com/Radius-Corner-Rounder-Punch-Cutter/dp/B0048IVWTI/ . . . ); U.S.

*Primary Examiner* — Sean M Michalski
(74) *Attorney, Agent, or Firm* — Northern Michigan Patent Law, PLC

(57) ABSTRACT

A handheld punch cutting device for cutting rounded corners in flat roll roofing material. The cutting device comprises a pair of handles terminating in flat plate-like reciprocating jaws, the upper jaw having an arcuate compression cutting blade and the lower jaw having a flat compression cutting plate with raised, spaced guides for locating a corner of roofing material centrally beneath the cutting blade. The height of the guides is less than the height of the blade, and the blade directly and continuously contacts a substantially flat cutting surface on the compression plate in order to complete a cut.

7 Claims, 6 Drawing Sheets

(56) References Cited

U.S. PATENT DOCUMENTS 4,053,979 A * 10/1977 Tuthill ..... A61B 17/0467 30/124
4,102,045 A * 7/1978 Bergh ..... B26B 17/02 30/178
4,106,195 A * 8/1978 Berg ..... B26B 17/00 30/178
4,630,366 A * 12/1986 Fry ..... A01B 1/16 254/132
4,817,287 A * 4/1989 Arnold ..... A61B 17/32053 30/178
4,831,910 A * 5/1989 Poulsen ..... B26D 3/14 144/217
4,894,913 A * 1/1990 Ladin ..... B26B 17/00 30/134
4,951,540 A * 8/1990 Cross ..... B26D 1/305 83/397
5,052,256 A * 10/1991 Morrissey ..... B26D 1/305 83/468
5,226,236 A * 7/1993 Harrington, III ..... A01G 3/02 30/131
5,499,565 A * 3/1996 Hansen ..... B26D 1/0006 83/452
5,542,182 A * 8/1996 Martinez ..... B26B 17/00 30/178
5,673,487 A * 10/1997 Malagnoux ..... B26B 17/00 30/179
5,740,713 A * 4/1998 Korb ..... B26D 3/14 83/582
5,832,612 A * 11/1998 Cornell ..... B26B 13/10 30/233
5,913,575 A * 6/1999 Lai ..... B26D 3/167 30/178
5,966,815 A * 10/1999 Sheikh ..... A61C 7/02 30/124
6,112,413 A * 9/2000 Frakes ..... B26D 1/095 30/229
6,412,382 B1 * 7/2002 Conley ..... B26D 1/205 83/468.2
6,438,924 B1 * 8/2002 Clover ..... B21D 28/243 30/134
6,581,293 B1 * 6/2003 Andersen ..... A61F 5/445 30/177
6,595,093 B1 * 7/2003 Artigas ..... B26D 1/30 83/468.3
6,752,054 B2 * 6/2004 Knight ..... B26B 13/26 30/251
6,757,978 B1 * 7/2004 Huang ..... B26B 17/00 30/178
6,840,078 B1 * 1/2005 Clover ..... B21D 28/243 30/134
7,328,513 B1 * 2/2008 Yang ..... B26B 17/02 30/178
8,327,548 B2 * 12/2012 Ronan ..... B26B 17/00 30/175
8,607,677 B2 * 12/2013 Nelson ..... A01G 3/08 30/186
8,863,626 B2 * 10/2014 Matsumura ..... B21D 28/16 83/49
9,339,876 B2 * 5/2016 Salinas ..... B26B 17/00
2001/0025422 A1 * 10/2001 Momosaki ..... B26B 17/006 30/178
2003/0229990 A1 * 12/2003 Douillard ..... B26B 17/00 30/175
2003/0229991 A1 * 12/2003 Chang ..... B26D 3/10 30/229
2005/0279201 A1 * 12/2005 Chang ..... B26D 3/10 83/589
2006/0053989 A1 * 3/2006 Weiss ..... B26D 3/10 83/13
2008/0072436 A1 * 3/2008 Frenken ..... B23D 17/02 30/175
2011/0174130 A1 * 7/2011 Zhang ..... B26D 1/12 83/602
2011/0289784 A1 * 12/2011 Jones ..... B26B 17/00 30/175
2011/0314982 A1 * 12/2011 Kubota ..... B26D 3/10 83/136
2013/0340263 A1 * 12/2013 Votolato ..... B26B 27/00 30/186
2014/0041195 A1 * 2/2014 Hoang ..... B25B 7/12 29/434
2015/0107431 A1 * 4/2015 Lin ..... B26D 3/10 83/588
2018/0229388 A1 * 8/2018 Runstrom ..... B26D 3/10

* cited by examiner

CORNER-ROUNDING COMPRESSION CUTTER FOR ROOFING MATERIAL

RELATED APPLICATIONS/PRIORITY BENEFIT CLAIM

This application claims the benefit of U.S. Provisional Application No. 62/458,642, filed Feb. 14, 2017 by the same inventor (Runstrom), the entirety of which provisional application is hereby incorporated by reference.

FIELD

The subject matter of the present application is in the field of handheld devices for cutting rounded corners in sheet materials.

BACKGROUND

Handheld devices for rounding corners for stationery and card-laminating purposes are known. One example is the commercially available "3 mm Radius Corner Rounder Punch Cutter—Heavy Duty Clipper" sold by Oregon Laminations Company. Cutters such as this use punch-like handles terminating in jaws, with a backer plate on the lower jaw having a blade-receiving shear recess or aperture, and with an arcuate shearing blade on the upper jaw. These devices are used for cutting aesthetic rounded corners in paper, cardboard, and laminated paper items.

U.S. Pat. No. 4,106,195 to Berg discloses handheld punch-type cutters for making aesthetic V-shaped cuts on decorative molding.

A common problem encountered in the flat roofing industry is the need to cut uniformly rounded corners in sheet-type roofing materials such as EPDM, PVC, or TPO thermoplastic roofing materials that comes in roll form. Roof sections with improperly rounded corners usually fail inspection and need to be re-done. Hand cutting with scissors or knives is also tiresome and time consuming.

BRIEF SUMMARY

The invention is a handheld punch for cutting rounded corners in flat sheet roofing materials, such as EPDM, PVC, and TPO, with a single squeeze. The cutter comprises a pair of pivoting handles oriented and operated in a vertical plane, the handles terminating in a pair of opposed plate-like jaws with co-acting faces arranged horizontally. The jaws are moved toward and away from each other by squeezing and releasing the handles. The upper jaw has an arcuate vertical blade extending downwardly toward the lower jaw, with a bevel or grind designed for compression cutting action. The lower jaw has a substantially flat backer plate facing the arcuate blade on the upper jaw, the backer plate of a material softer than the blade, such as a cut-resistant plastic, with one or more raised guides to center a corner of roofing material on the backer plate underneath the blade.

In a further form, the lower jaw has a forward spatula edge shaped to easily slide underneath, lift, and guide a corner of roofing material onto the backer plate.

In a further form, the handle axis is set at an acute angle relative to the jaws, such that when the jaws are horizontal the handles are angled upwardly at a comfortable cutting angle.

In a further form, one or both of the blade and the backer plate are removable for replacement or repair. In still a further form, the blade can be reversibly mounted on the upper jaw to make reverse arcuate cuts, for example when a round corner is desired where the roofing material corner terminates at a vent pipe.

Terms of orientation such as "vertical" and "horizontal" are used herein with respect to the cutter as relative terms of preferred orientation when making a cut.

These and other features and advantages of the invention will become apparent from the detailed description below, in light of the accompanying drawings.

DETAILED DESCRIPTION

Figure 1:
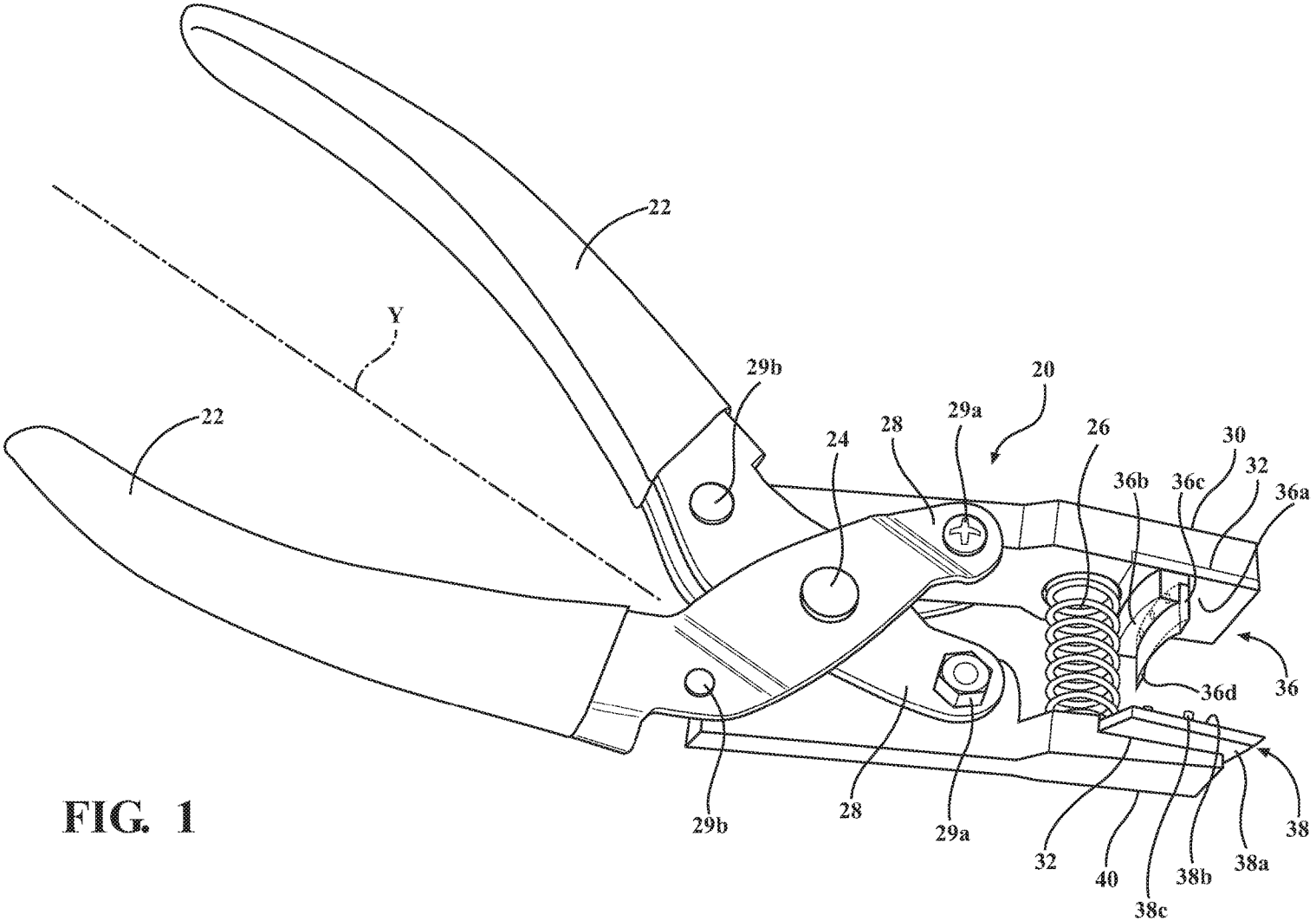
FIG. 1 is a perspective view of an example cutter according to the invention.

Referring first to FIGS. 1-4, a cutter 20 according to the invention is shown in exemplary form in order to teach how to make and use the claimed invention. Cutter 20 comprises a pair of handles 22, similar to those on pliers, tin snips, and other punch-type cutting tools, the handles arranged in a vertical plane and pivoting about a pin or similar pivot connection 24.

Handles 22 are normally biased apart by a spring 26 acting on their outer split ends 28, for example through upper and lower jaws 30 and 40 connected to ends 28 in non-pivoting or fixed fashion at connectors 29*a* and in pivoting fashion at pivot pins 29*b*. Squeezing the handles 22 together causes the upper and lower jaws 30, 40 to close toward one another in known manner.

Handles 22 and jaws 30, 40 are preferably made from metal, for example forged or cast steel, although other materials such as tough, rigid polymers could possibly be used.

Figure 2:
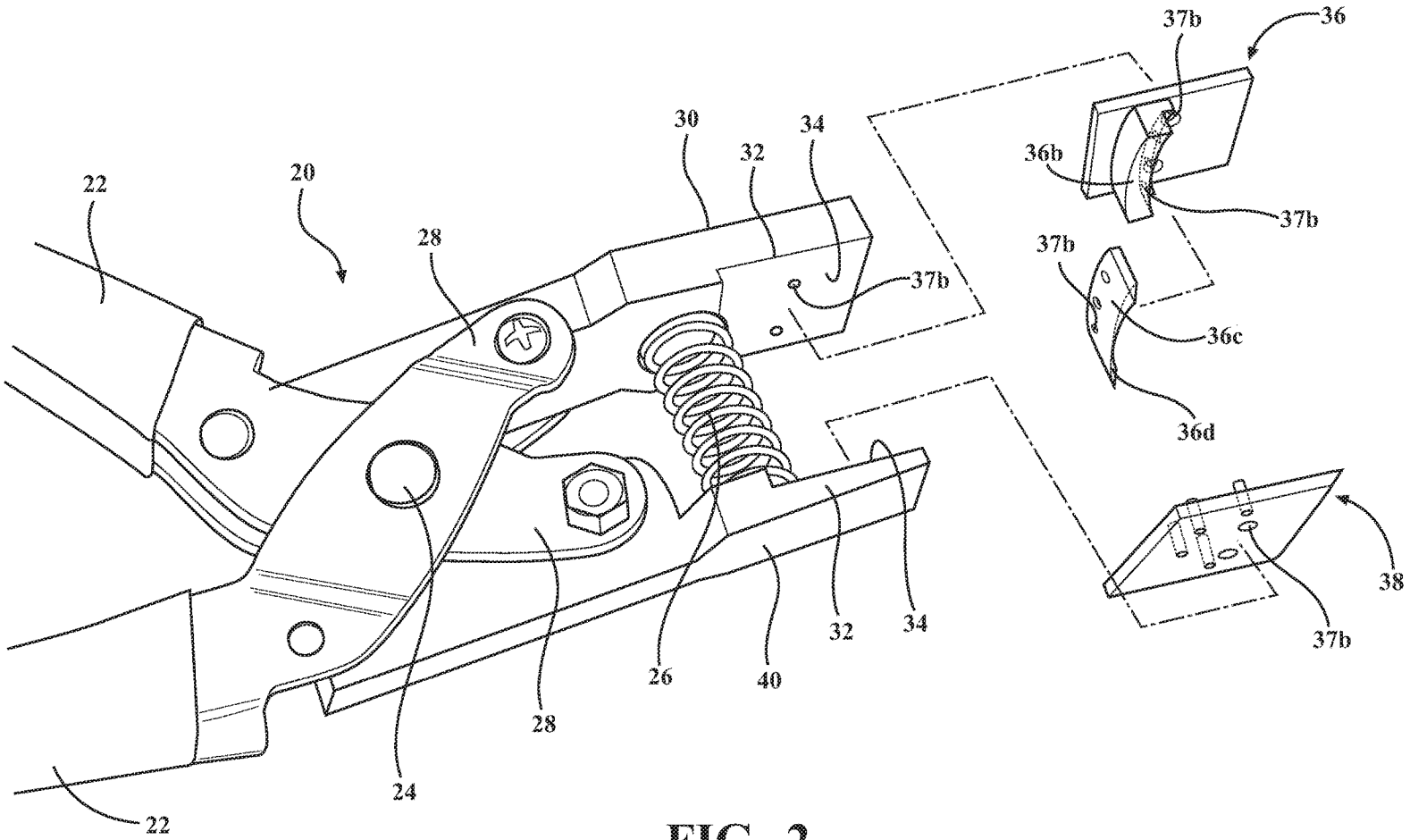
FIG. 2 is an exploded view of the cutter of FIG. 1.
Figure 3:
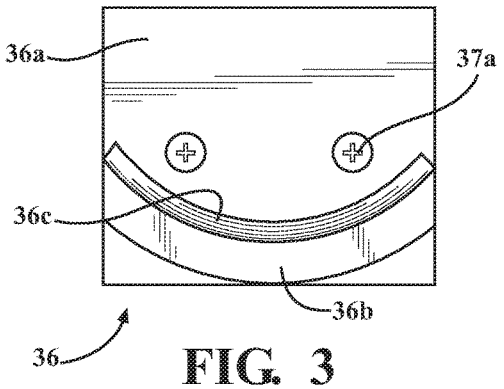
FIG. 3 is a plan view of the upper jaw blade assembly of the cutter of FIG. 1.
Figure 4:
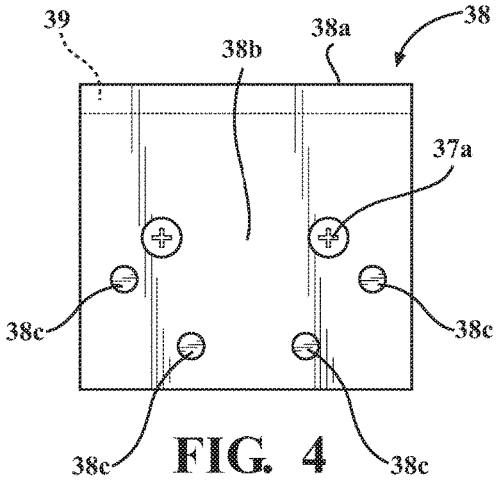
FIG. 4 is a plan view of the lower jaw cutting plate assembly of the cutter of FIG. 1.

Jaws 30 and 40 may be substantially identical as shown, at least in terms of their base structure, comprising flat, platen or plate-like outer ends 32 defining mounting surfaces 34 for a blade assembly 36 on the upper jaw 30 and a compression plate assembly 38 on the lower jaw 40. Blade assembly 36 and compression plate assembly 38 are preferably removably attached to their respective jaws, for example with machine screws 37*a* inserted through mating threaded bores 37*b* in the jaws and plates as best shown in FIGS. 2-4.

Blade assembly 36 comprises a flat base 36*a* with an arcuate blade 36*c* which may be an integral part of base 36*a* or which may be detachably secured to base 36*a* for replacement. In the illustrated example, base 36*a* comprises an arcuate mounting lug 36*b* integral with base plate 36*a* and having a circumferential length corresponding to that of the blade 36*c*. Blade 36*c* is accordingly attached with screws 37*a* or similar to lug 36*b* through mating bores 37*b* in the blade and lug.

Compression plate assembly 38 comprises a flat base 38*a* with a solid flat cutting surface 38*b* which may be an integral part of lower jaw 40, but is preferably removable for replacement as shown in the illustrated example. Base 38*a* includes a pattern of raised guides 38*c*, for example shaped as short pins or studs, which help to locate a corner of roofing material being cut. Guides 38*c* extend from base 38*a* less than the distance that blade 36*c* extends from base 36*a*.

Blade 36*c* has a single-grind or single-bevel edge 36*d* to provide a compression rather than a shearing type cut when closing against the surface of base plate 38*a*.

As further shown in FIGS. 1-4, handles 22 are spaced apart and move in a vertical plane about a horizontal pivot. The flat co-acting faces of jaws 30, 40 are arranged horizontally relative to the operating plane of the handles. Further, the handles 22 are offset at an acute angle to jaws 30, 40, with an overall handle axis Y running between them and bisecting pivot 24 at an angle such as 30° degrees from horizontal. This angled offset of the handles relative to the jaws allows a worker to comfortably engage a horizontal piece of flat roofing material with the jaws without having to scrape knuckles or significantly lift the material for the cut.

Also shown in FIGS. 1 and 2 is a spatula-like tapered extended leading edge 39 on lower jaw 40 and/or compression plate 38, designed to slide easily under the roofing material and to guide the roofing material smoothly into the guide pins 38*c*.

Figure 2A:
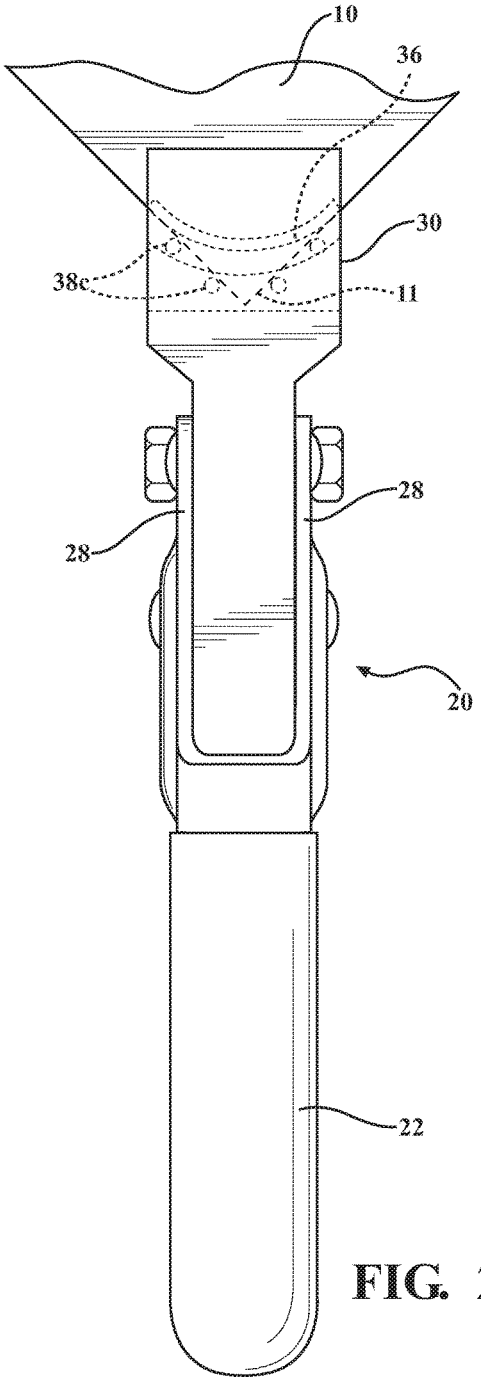
FIGS. 2A and 2B are top plan views of the cutter of FIG. 1, positioned relative to an outside corner of roofing material before/during and after making a cut.
Figure 2B:
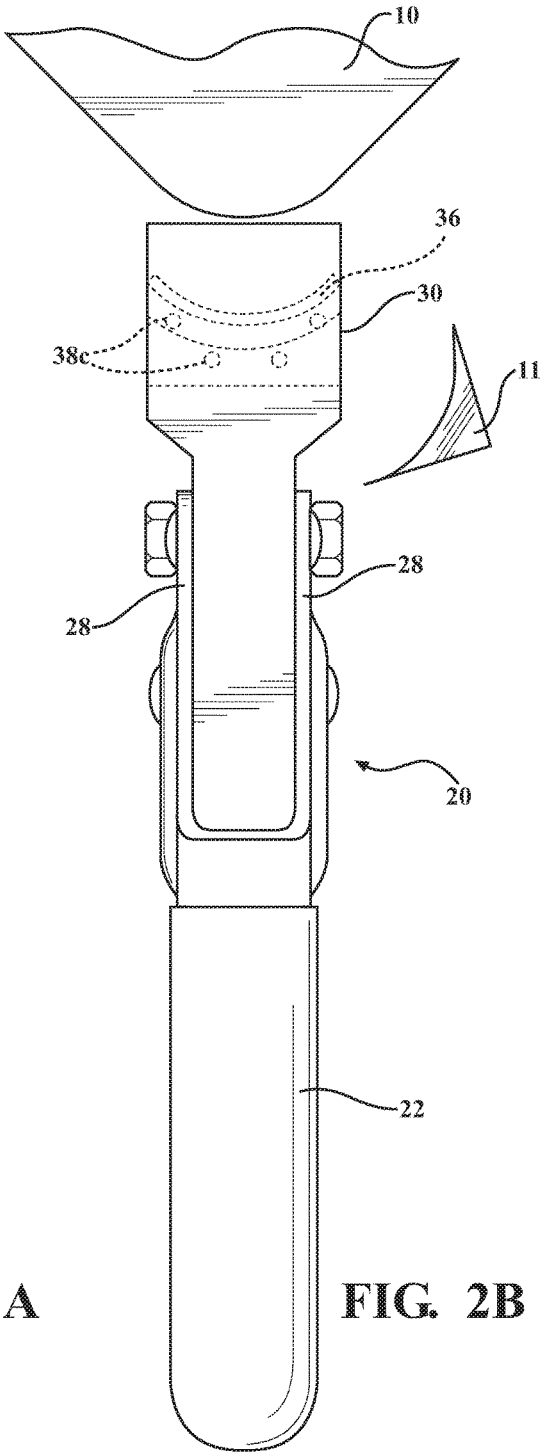

Referring to FIGS. 2A and 2B, a piece of flat roofing material 10 is shown with an outside corner 11 inserted between jaws 30, 40 of cutter 20. Spaced guide pins 38*c* guide corner 11 into a centered position on jaw 40 so that blade 26*c* on jaw 30 can make a centered cut.

In FIGS. 2A and 2B, blade 36*c* is oriented in concave fashion relative to the roofing material 10, in order to make a convex cut in outside corner 11. This type of cut is used where the corner of the roofing material terminates in an open area, or against a flat roof feature, or in a corner of the roof.

Figure 5A:
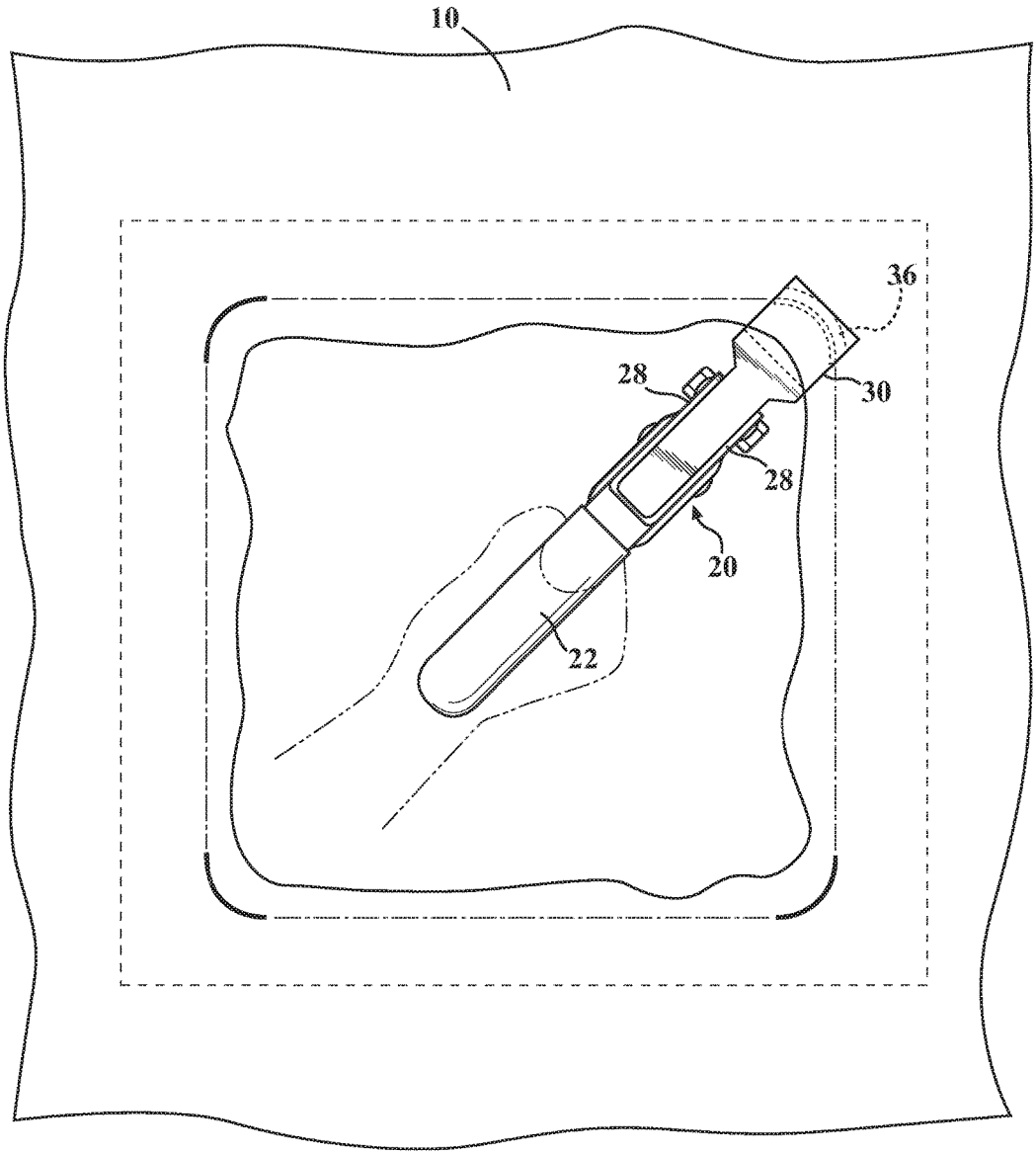
FIGS. 5A and 5B are similar to FIGS. 2A and 2B, but with the blade assembly reversed to make a rounded cut in an inside corner of roofing material.
Figure 5B:
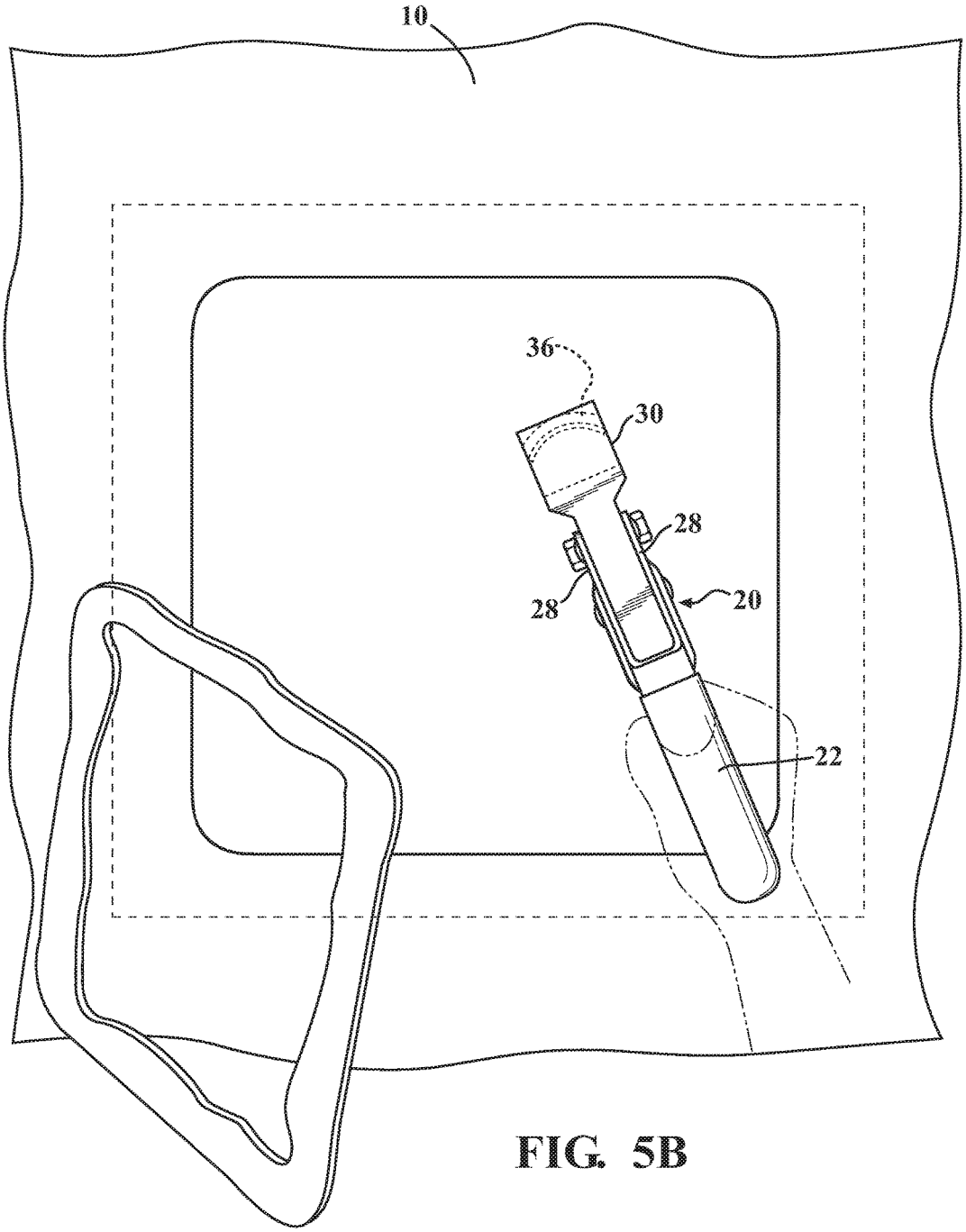

FIGS. 5A and 5B show blade 36*c* reversed on jaw 30, with the blade oriented in convex fashion to make a concave rounded "pilot" corner when forming an inside corner for a square of material to be removed from roofing material 10. This type of cut is used where the roofing material surrounds a roof feature such as a duct or drain opening with a square opening and the inner corners of the square opening need to be rounded off. For this type of cut the guide pins shown in FIGS. 1-4 are unnecessary.

While a reversible blade and/or blade base plate on the upper jaw is an option, it is more convenient and preferable to have dedicated cutters 20 whose blades are non-reversibly mounted for either a convex or concave cut.

Figure 6A:
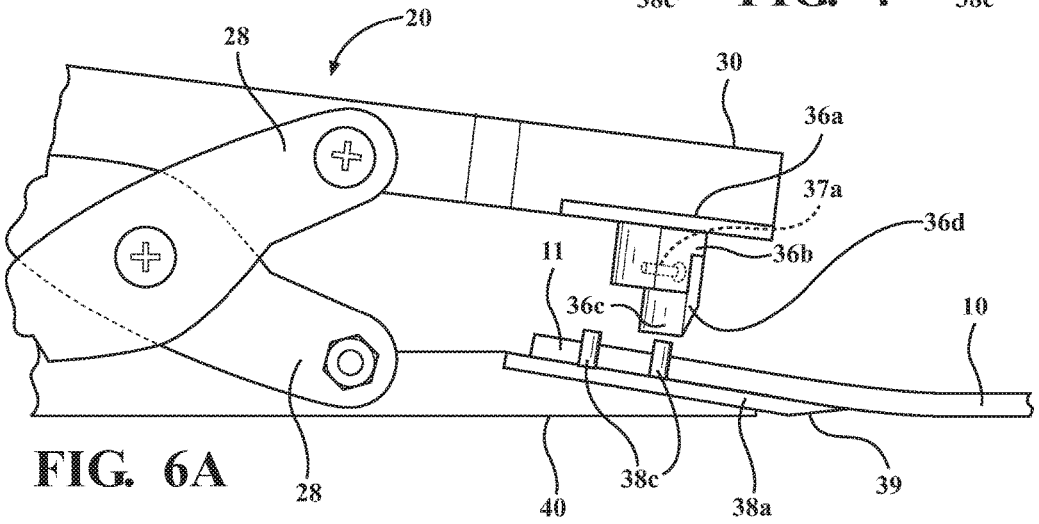
FIGS. 6A and 6B are side elevation views of the jaws of the cutter of FIG. 1, before and during a cut.
Figure 6B:
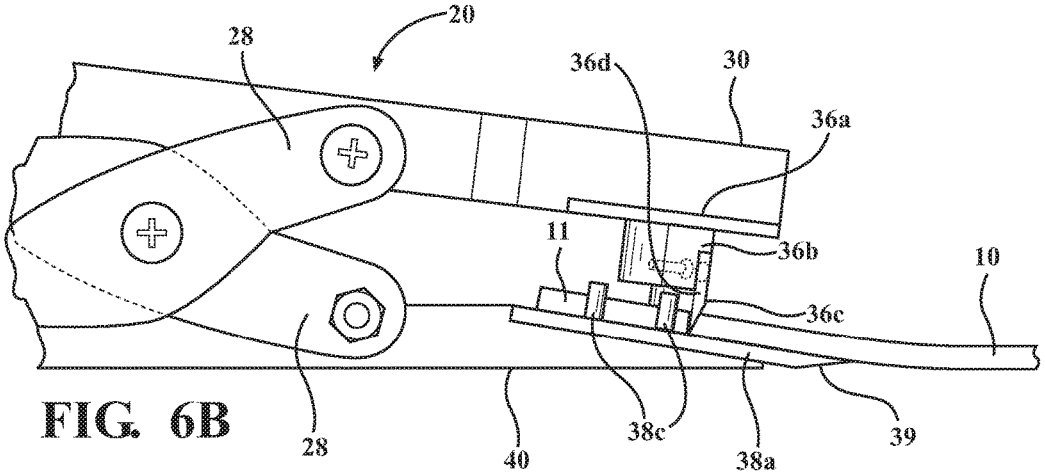

FIGS. 6A and 6B are side elevation views of the cutter 20 and the concave mounted blade arrangement of FIGS. 2A and 2B, in the open and closed positions. Guide pins 38*c* are short enough not to interfere with the closing of blade 36*c* against cutting face 38*a* of compression plate 38. Further, the spaced pattern of guides 38*c* may optionally provide passage for the arcuate blade 36*c* between them upon closing to complete the cut.

As noted above, blade 36*c* preferably has a single-bevel or single-grind edge 36*d* which, coupled with the flat edge-to-face contact with the flat cutting surface of compression plate 38, results in a compression rather than a shearing cut, and which is capable of cleanly severing the thermoplastic roofing material. Compression plate 38, or at least its cutting surface 38*b*, is accordingly made from a cut-resistant material (e.g., polycarbonate or nylon type plastics, or a softer metal such as brass or aluminum) softer than the hardened steel of blade 36*c*, but hard enough to resist the formation of deep scoring or grooving from the edge of the blade in order to continue making clean compression cuts for the life of the plate. Cutting surface 38*b* could be limited to a portion of the cutting plate corresponding to the size and shape of the blade.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in other application claiming priority to this application.

The invention claimed is:

1. A handheld punch cutting device for cutting rounded corners in flat sheet type thermoplastic roofing materials, comprising:

a pair of pivoting handles connected and biased away from each other in a generally vertical plane, the handles terminating in a pair of respective plate-like upper and lower jaws with respective opposed, substantially flat co-acting faces arranged in a generally horizontal plane and moved toward and away from each other to respective closed and open positions by squeezing and releasing the handles;

the upper jaw co-acting face comprising a generally vertical arcuate compression cutting blade extending a first distance downwardly from the upper jaw co-acting face;

the lower jaw co-acting face comprising a substantially flat compression cutting plate secured thereto, the compression cutting plate comprising a cutting surface of a material softer than the arcuate compression cutting blade, the lower jaw further comprising spaced raised guides extending a second distance upwardly above the cutting surface of the compression cutting plate, the second distance being less than the first distance, the raised spaced guides spaced inwardly on the lower jaw from an outer leading edge of the lower jaw toward the handles and configured to define an angled, narrowing, corner-shaped corner receiving area for a corner of roofing material on the lower jaw located between the spaced raised guides inwardly of and centered relative to the cutting blade in the closed position ; wherein, the arcuate compression cutting blade on the upper jaw is aligned with the raised spaced guides on the lower jaw at a location adjacent but outwardly of the raised spaced guides on the lower jaw when the upper and lower jaws are in the closed position, such that the arcuate compression cutting blade makes direct and continuous contact with the cutting surface on the compression cutting plate adjacent but outwardly of the raised spaced guides to complete a cut.

2. The handheld punch cutting device of claim 1, wherein the outer leading edge of the lower jaw comprises a spatula edge of decreasing thickness shaped to slide underneath and lift and guide a corner of roofing material onto the compression cutting plate and into the corner receiving area defined by the raised spaced guides.

3. The handheld punch cutting device of claim 2, wherein the spatula edge comprises an extension of the compression cutting plate.

4. The handheld punch cutting device of claim 1, wherein the handles are set at an acute upward angle relative to the horizontal plane of the upper and lower jaws, such that when the upper and lower jaws are horizontal the handles are angled upwardly relative to the upper and lower jaws.

5. The handheld punch cutting device of claim 1, wherein at least one of the arcuate cutting blade and the compression cutting plate is removable from its respective upper and lower jaw for replacement or repair.

6. The handheld punch cutting device of claim 1, wherein the arcuate cutting blade is reversibly mounted on the upper jaw to make reverse arcuate cuts.

7. The handheld punch cutting device of claim 1, wherein the arcuate cutting blade has a width extending laterally in a first direction generally perpendicular to the handles across the lower jaw greater than a lateral spacing of the raised spaced guides and the corner receiving area on the lower jaw.

* * * * *